US007540769B1

(12) United States Patent
Shen et al.

(10) Patent No.: US 7,540,769 B1
(45) Date of Patent: Jun. 2, 2009

(54) RECEPTACLE CONNECTOR

(75) Inventors: Lili Shen, Tu-Cheng (TW); Hong-tu Zhang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 10 days.

(21) Appl. No.: 11/984,448

(22) Filed: Nov. 19, 2007

(51) Int. Cl.
*H01R 13/73* (2006.01)

(52) U.S. Cl. ..... 439/564; 439/441; 439/660

(58) Field of Classification Search ..... 439/564, 439/565, 441, 660, 668
See application file for complete search history.

(56) References Cited

U.S. PATENT DOCUMENTS 5,127,852 A * 7/1992 Cravens et al. ..... 439/545
6,174,185 B1 * 1/2001 Cecil, Jr. ..... 439/248
6,752,638 B2 * 6/2004 Na ..... 439/76.1
2006/0199429 A1 * 9/2006 Chang et al. ..... 439/564
2008/0214045 A1 * 9/2008 Tu et al. ..... 439/540.1

* cited by examiner

*Primary Examiner*—Hien Vu
(74) *Attorney, Agent, or Firm*—Rosenberg, Klein & Lee

(57) ABSTRACT

A receptacle connector includes an insulating body, a plurality of terminals and a housing. The insulating body defines a plurality of cavities for receiving the terminals. The housing defines a receiving space for receiving the insulating body and a locking space for fixing a plug connector. Two opposite sides of a top wall of the housing respectively extend sideward to form a pair of wings. The wing defines a locking aperture passing through a top and a bottom thereof. The middle of the top wall protrudes upward to form a locking lump. The middle of the rear of the top wall protrudes upward to form a connecting section adjacent to the rear of the locking lump. The locking aperture, the locking lump and the connecting section respectively buckle with corresponding structures of a fixing device.

4 Claims, 4 Drawing Sheets

RECEPTACLE CONNECTOR

BACKGROUND OF THE INVENTION

1. Field of the Invention

The present invention generally relates to a connector, and more particularly to a receptacle connector.

2. The Related Art

Traditionally, a receptacle connector includes an insulating body, a plurality of terminals and a housing. The insulating body defines a plurality of cavities for receiving the terminals. Each terminal has a contact portion. The housing defines a receiving space for receiving the insulating body with the terminals. When a plug connector inserts into the receptacle connector, terminals of the plug connector contact the corresponding contact portions of the terminals of the receptacle connector.

The housing of the receptacle connector further has a rectangular latch mechanism which protrudes downward from the middle of a bottom of the housing. When the receptacle connector engages with a corresponding fixing device, the latch mechanism is received in a rectangular locking recess of the fixing device to fix the receptacle connector in the fixing device. When the plug connector inserts into and pulls out from the receptacle connector, the strength generated thereby concentrates on the latch mechanism so that the latch mechanism is apt to crack. Therefore, the receptacle connector is apt to fall off the fixing device.

SUMMARY OF THE INVENTION

An object of the present invention is to provide a receptacle connector, which can engage with a corresponding fixing device firmly.

The receptacle connector includes an insulating body, a plurality of terminals and a housing. The insulating body defines a plurality of cavities. The terminal is received in the corresponding cavity. The housing has a top wall, a bottom wall and two sidewalls. A baffle is disposed between the sidewalls. The top wall, the bottom wall, the sidewalls and the baffle define a receiving space for receiving the insulating body and a locking space for fixing a plug connector. Two opposite sides of the top wall respectively extend sideward to form a pair of wings. The wing defines a locking aperture passing through a top and a bottom thereof. The middle of the top wall protrudes upward to form a locking lump. The middle of the rear of the top wall protrudes upward to form a connecting section adjacent to the rear of the locking lump.

As described above, when the receptacle connector is configured to a corresponding fixing device, the locking aperture, the locking lump and the connecting section respectively buckle with corresponding structures of the fixing device to ensure that the receptacle connector and the fixing device engage with each other firmly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
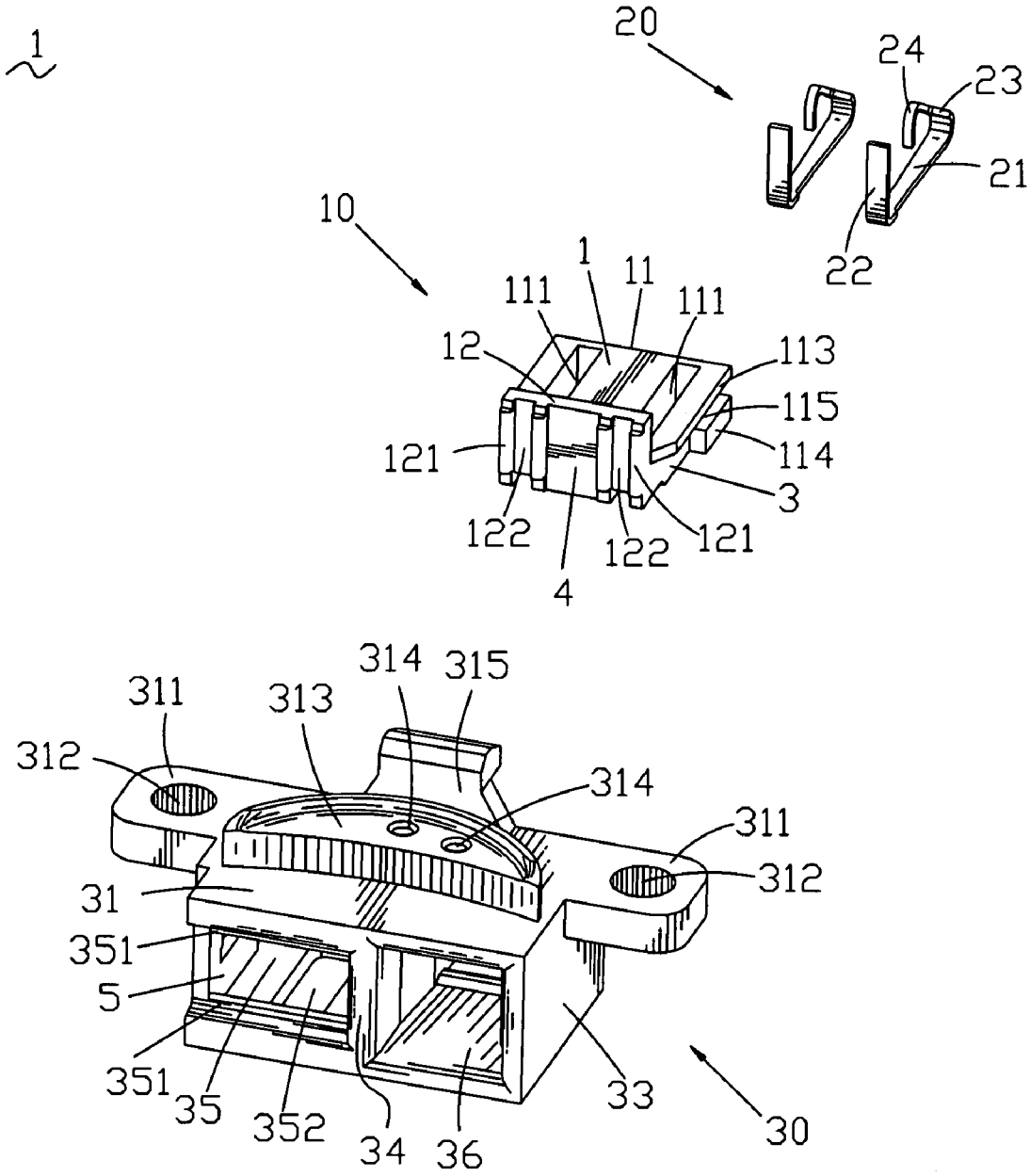
FIG. 1 is an exploded view of a receptacle connector in accordance with the present invention.

With reference to FIG. 1, a receptacle connector 1 includes an insulating body 10, a pair of terminals 20 configured in the insulating body 10 and a housing 30 for receiving the insulating body 10 with the terminals 20.

Figure 2:
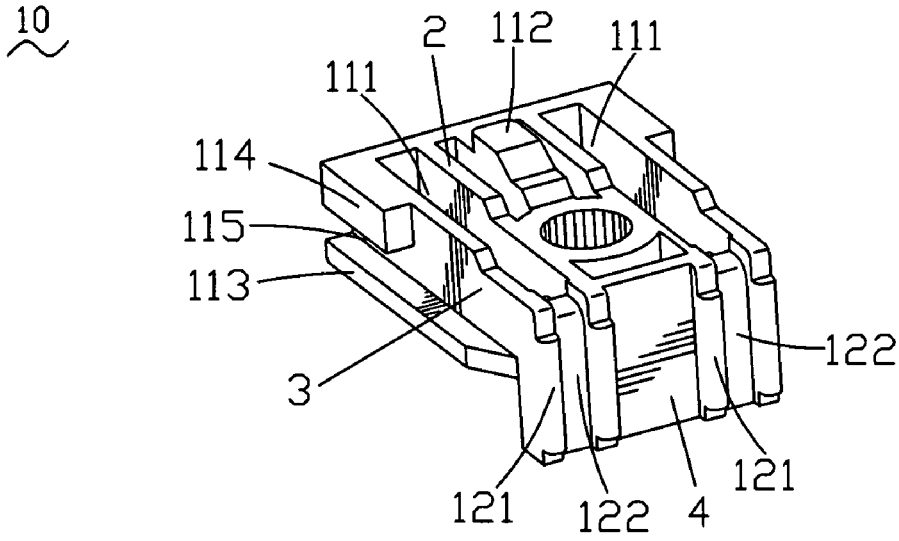
FIG. 2 is a perspective view of an insulating body of the receptacle connector of FIG. 1.

Referring to FIG. 1 and FIG. 2, the insulating body 10 has a base 11. Two sides of the base 11 respectively longitudinally define a first cavity 111 passing through a top surface 1 and a bottom surface 2 thereof. The middle of a rear of the bottom surface 2 of the base 11 protrudes downward to form a fixing block 112. A top of each side surface 3 of the base 11 protrudes sideward to form a first beam 113 and a rear of a bottom of each side surface 3 of the base 11 protrudes sideward to form a second beam 114. Accordingly, a fixing channel 115 is formed between the first beam 113 and the second beam 114. A front of the base 11 vertically extends upward to form a preventing wall 12. Two sides of a front surface 4 of the preventing wall 12 respectively vertically define a pair of ribs 121, accordingly, two second cavities 122 are respectively defined between the corresponding two ribs 121 and communicate with the corresponding first cavities 111.

Referring to FIG. 1, each terminal 20 has a fixing portion 21 which is a longitudinal long-strip shape. A front of the fixing portion 21 vertically extends upward to form a contact portion 22. A rear end of the fixing portion 21 bends upward and then extends obliquely upward and forward to form an elastic portion 23. A bent portion 24 extends from one side of a free end of the elastic portion 23 and then bends downward.

Figure 3:
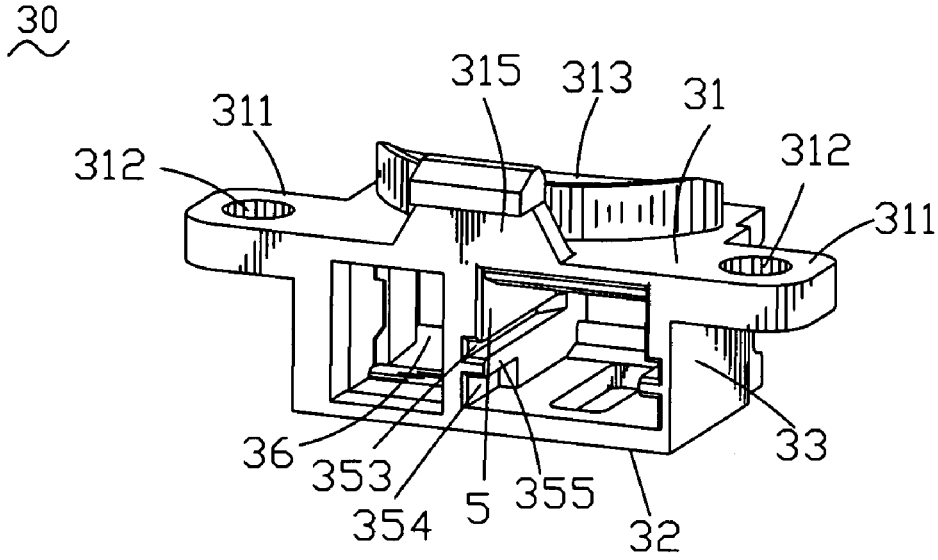
FIG. 3 is a perspective view of a housing of the receptacle connector of FIG. 1.

Referring to FIG. 1 and FIG. 3, the housing 30 has a top wall 31, a bottom wall 32 and two sidewalls 33. A baffle 34 is disposed between the two sidewalls 33 and parallel with the sidewall 33, and connects with the top wall 31 and the bottom wall 32. The baffle 34, the top wall 31, the bottom wall 32 and the two sidewalls 33 define a receiving space 35 for receiving the insulating body 10 and a locking space 36 for fixing a plug connector (not shown). The front of the top wall 31 and the bottom wall 32 extends to the receiving space 35 to form a pair of preventing edges 351 facing to each other. The middle of a rear of the bottom wall 32 defines a fixing groove 352 communicating with the receiving space 35 which corresponds to the fixing block 112 of the insulating body 10. A rear of each side surface 5 of the receiving space 35 longitudinally defines a first channel 353 and a second channel 354 which communicate with the receiving space 35 and respectively correspond to the first beam 113 and the second beam 114 of the insulating body 10. Accordingly, a fixing beam 355 is formed between the first channel 353 and the second channel 354 in accordance with the fixing channel 115 of the insulating body 10. Two opposite sides of a rear of the top wall 31 respectively extend sideward to form a pair of wings 311 and the wing 311 defines a locking aperture 312 passing through a top and bottom thereof. The middle of the top wall 31 protrudes upward to form a crescent locking lump 313 which is surrounded by a first arc surface at the rear and a second arc surface shorter than the first arc surface at the front. A top of the locking lump 313 defines a plurality of locking holes 314. The middle of the rear of the top wall 31 protrudes upward to form an isosceles-trapezoid connecting section 315 becoming narrow from bottom to top gradually and adjacent to the rear of the locking lump 313. A free end of the connecting section 315 extends upward and then protrudes rearward a little.

Figure 4:
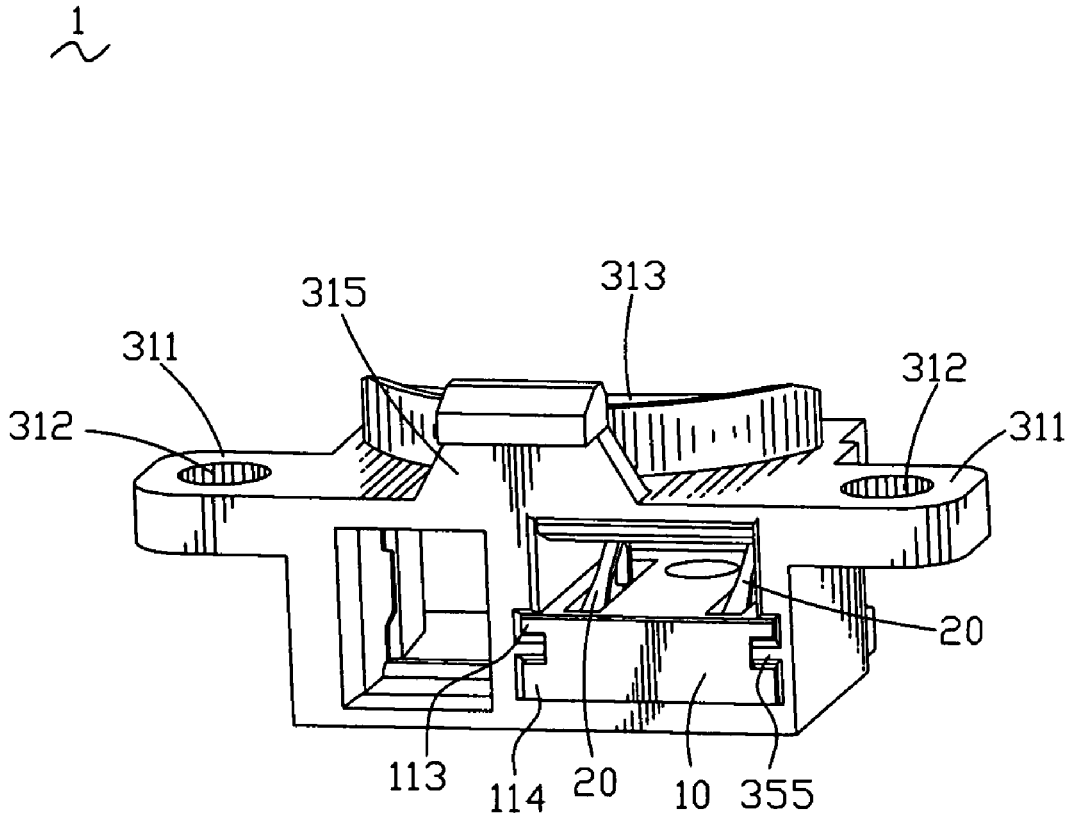
FIG. 4 is a perspective assembly view of the receptacle connector of FIG. 1.

Referring to FIG. 4, in assembly, the terminal 20 is received in the insulating body 10, the insulating body 10 with the terminals 20 is configured in the corresponding receiving space 35 of the housing 30. The contact portion 22 of the terminal 20 is received in the corresponding second cavity 122 of the insulating body 10. The fixing portion 21 is received in the first cavity 111. The elastic portion 23 is received in the first cavity 111 and the bent portion 24 protrudes into the receiving space 35 of the housing 30 from the top surface 1 of the base 11 of the insulating body 10. The first beam 113 and the second beam 114 of the insulating body 10 are respectively received in the corresponding first channel 353 and second channel 354. Accordingly, the fixing beam 355 buckles into the corresponding fixing channel 115. The preventing wall 12 of the insulating body 10 abuts against the preventing edges 351 of the housing 30 and the fixing block 112 buckles into the corresponding fixing groove 352.

Figure 5:
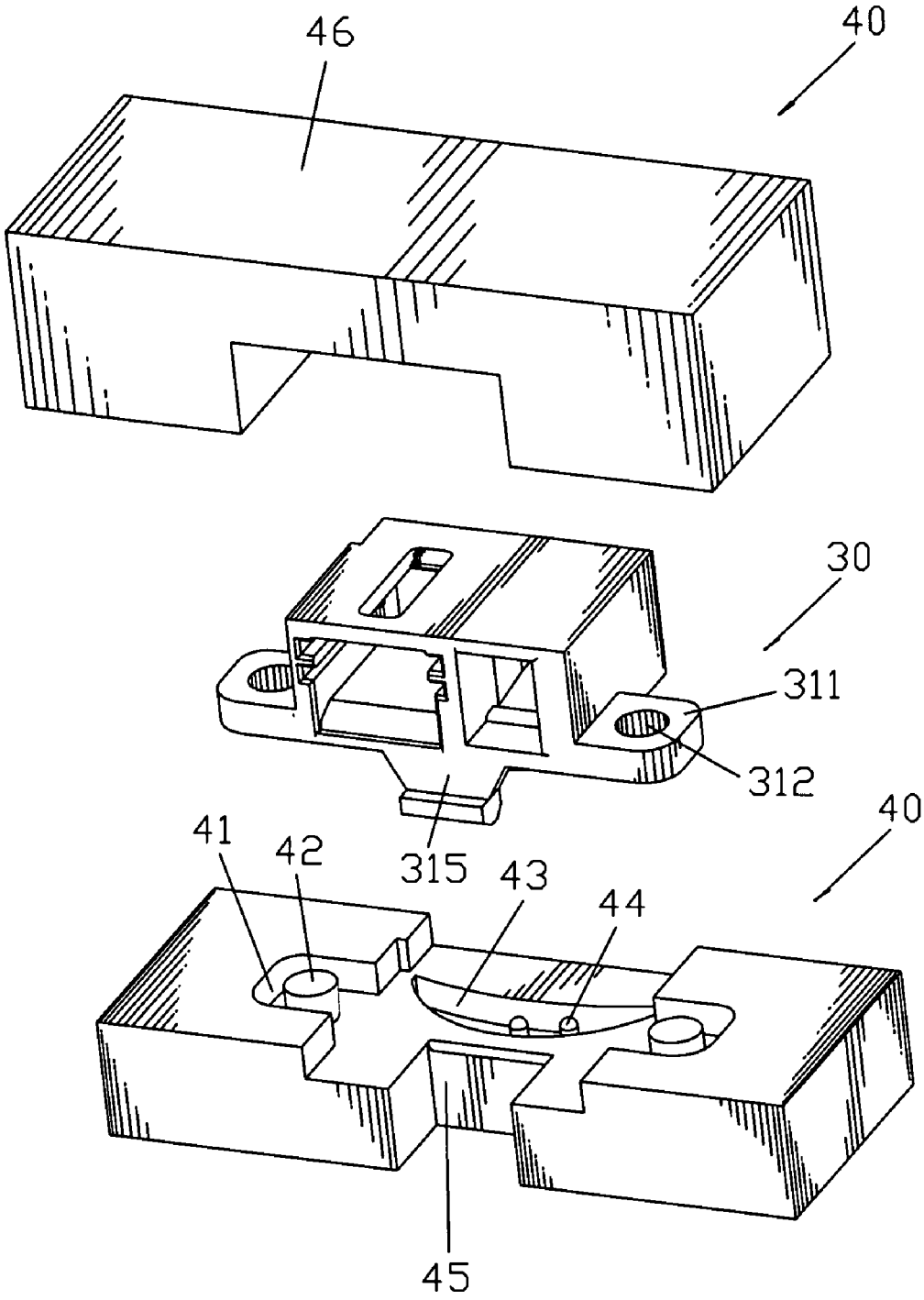
FIG. 5 is an exploded view showing the housing of the receptacle connector engaging with a fixing device.

Referring to FIG. 5, when the receptacle connector 1 is configured to a fixing device 40, the wing 311 of the housing 30 is received in a corresponding recess 41, and a first pillar 42 of the fixing device 40 is inserted into the corresponding locking aperture 312. The crescent locking lump 313 (FIG. 1) is received in a crescent locking recess 43, and a second pillar 44 of the fixing device 40 is inserted into the corresponding locking hole 314 (FIG. 1). The connecting section 315 is locked in a rectangular fixing recess 45. A cover 46 of the fixing device 40 is covered on the housing 30 of the receptacle connector 1.

As described above, when the receptacle connector 1 engages with the fixing device 40, the locking aperture 312, the crescent locking lump 313 and the connecting section 315 respectively buckle with corresponding structures of the fixing device 40 to ensure that the receptacle connector 1 and the fixing device 40 engage with each other firmly.

What is claimed is:

1. A receptacle connector, comprising:

an insulating defining a plurality of cavities, a bottom of the insulating body protruding downwardly to form a fixing block;

a plurality of terminals received in the corresponding cavities of the insulating body; and a housing having a top wall, a bottom wall and two sidewalls, the housing having a baffle disposed between the sidewalls, the top wall, and the bottom wall, to define a receiving space for receiving the insulating body and a locking space for receiving an electrical plug connector, two opposite sides of the top wall respectively extending sideward to form a pair of wings, each of the wings having a locking aperture passing through a top and bottom thereof, a middle of the top wall protruding upwardly to form a locking lump having a curved shape extending from one side to another side of the top wall and having a locking hole in the locking lump, a middle of a rear of the top wall protruding upwardly to form a connecting section adjacent to a rear of the locking lump, the bottom wall of the housing defining a fixing groove communicating with the receiving space, the fixing block buckles into the fixed groove.

2. The receptacle connector as claimed in claim 1, wherein a top of the locking lump of the housing defines a plurality of locking holes.

3. The receptacle connector as claimed in claim 1, wherein two opposite sides of the insulating body respectively longitudinally define a pair of parallel beams, two side surfaces of the receiving space of the housing respectively define a pair of channels communicating with the receiving space and corresponding to the beams of the insulating body.

4. The receptacle connector as claimed in claim 1, wherein the locking lump of the housing is a crescent shape, surrounded by a first arc surface at the rear and a second arc surface shorter than the first arc surface at the front.

* * * * *